United States Patent [19]

Pattyn et al.

[11] 4,082,554

[45] Apr. 4, 1978

[54] DIRECT-POSITIVE SILVER HALIDE EMULSIONS

[75] Inventors: Herman Alberik Pattyn, Kapellen; Willy Joseph Vanassche, Kontich; Herman Adelbert Philippaerts, Edegem, all of Belgium

[73] Assignee: AGFA-GEVAERT N.V., Mortsel, Belgium

[21] Appl. No.: 561,658

[22] Filed: Mar. 24, 1975

[30] Foreign Application Priority Data

Apr. 3, 1974 United Kingdom ..... 14801/74

[51] Int. Cl.[2] ..... G03C 1/36; G03C 1/28

[52] U.S. Cl. ..... 96/101; 96/108; 96/112

[58] Field of Search ..... 96/101, 108, 112

[56] References Cited

U.S. PATENT DOCUMENTS

| | | | |
|---|---|---|---|
| 3,501,305 | 3/1970 | Illingsworth | 96/108 |
| 3,501,306 | 3/1970 | Illingsworth | 96/101 |
| 3,615,610 | 10/1971 | Florens | 96/101 |

FOREIGN PATENT DOCUMENTS

| | | | |
|---|---|---|---|
| 723,019 | 2/1955 | United Kingdom | 96/108 |

*Primary Examiner*—Won H. Louie, Jr.
*Attorney, Agent, or Firm*—A. W. Breiner

[57] ABSTRACT

Reduction and gold fogged Lippmann emulsions are described wherein the emulsion is fogged with from 0.07 to 0.5 milliequivalents of reduction fogging agent and from 0.01 to 0.1 millimole of gold fogging agent per mole of silver halide and the emulsion comprises more than 2 g and at most 10 g of electron acceptor(s) per mole of silver halide.

10 Claims, No Drawings

DIRECT-POSITIVE SILVER HALIDE EMULSIONS

The present invention relates to direct-positive silver halide emulsions comprising fogged silver halide grains with an average grain diameter of less than 100 nm.

It is known that direct-positive images can be obtained with certain types of photographic silver halide emulsions without previously forming a negative silver image. As described in British patent specification No. 723,019 one photographic emulsion of this type is a photographic emulsion comprising one or more electron-trapping compounds and silver halide grains which are fogged with a combination of a reducing agent and a gold compound or a compound of a metal more electropositive than silver e.g. palladium or platinum.

According to U.S. Pat. Nos. 3,501,305 and 3,501,306 improved photographic direct-positive emulsions of this type are obtained with monodispersed direct-positive emulsions, i.e. emulsions the grains of which have substantially the same diameter, more particularly at least 95% by weight or number of the silver halide grains are of a size which is within about 40% of the mean grain size, and with regular grain direct-positive emulsions i.e. emulsions of which at least 80% by weight of the grains have a regular crystal shape. These emulsions are preferably emulsions obtained by combining a low level of gold fogging with a low level of reduction fogging.

Although according to the above U.S. Patents the mean grain diameter of the direct-positive silver halide emulsions may be comprised between about 10 nm and about 2000 nm so that Lippmann emulsions, which have an average grain diameter of less than 100 nm and preferably less than 80 nm, are embraced, the teachings of the above U.S. Patents do not permit to obtain direct-positive silver halide Lippmann emulsions yielding upon exposure and development direct-positive images of sufficient overall contrast, sufficient contrast in the highlight areas and sufficient maximum density.

Lippmann emulsions are of particular importance for the preparation of photographic plates or films with high resolution, for use in microphotography and astrophotography, for recording nucleo-physical phenomena, for the preparation of masks in the production of microelectronic integrated circuits, for use in holography, for high-density data storage, etc.

It has now been found that improved direct-positive images as regards, overall contrast, contrast in the highlight areas and maximum density are obtained upon exposure and development of a direct-positive silver halide Lippmann emulsion comprising reduction and gold fogged silver halide grains of an average grain diameter of less than 100 nm and at least one electron accepting compound when the silver halide grains are fogged with from about 0.07 to about 0.5 milliequivalent per mole of silver halide of a reduction fogging agent and with from about 0.01 to about 0.1 millimole per mole of silver halide of a gold fogging agent and the silver halide emulsion layer comprises per mole of silver halide more than 2 g and at most about 10 g of electron-accepting compound(s).

The present invention therefore provides a direct-positive silver halide emulsion comprising reduction and gold fogged silver halide grains and at least one electron accepting compound wherein 1. the silver halide grains have an average grain diameter of less than 100 nm, 2. the silver halide grains are fogged with, per mole of silver halide, from about 0.07 to about 0.5 milliequivalent reduction fogging agent and from about 0.01 to about 0.1 millimole of gold fogging agent and 3. the emulsion comprises per mole of silver halide more than 2 g and at most about 10 g of electron-accepting compound(s).

The silver halide emulsions according to the present invention are emulsions of the Lippmann type. They have an average grain diameter less than 100 nm, preferably less than 80 nm, and may be prepared according to methods well known in the art and described in the literature (see e.g. P. Glafkidès, "Photographic Chemistry", Vol. I, 1958, pages 365–368, K. Mees "The theory of the photographic process", 1966, p. 36 and National Physical Laboratory "Notes on Applied Science" no. 20: "Small scale preparation of fine-grain (colloidal) photographic emulsions" B. H. Crawford, London, 1960. They may also be prepared according to the technique described in French Pat. No. 2,092,505.

The direct-positive silver halide Lippmann emulsions are reduction- and gold-fogged which means that they are fogged with a combination of a reducing fogging agent and a gold fogging agent.

The reducing fogging agent is used in an amount from about 0.07 to about 0.5 milliequivalents, preferably from about 0.1 to about 0.3 milliequivalents per mole of silver halide. A preferred reducing fogging agent is thiourea dioxide, which is preferably employed in the range of about 4 mg to about 30 mg, most preferably from about 5 mg to about 15 mg per mole of silver halide. Other suitable reducing agents are tin(II) salts which include tin chloride, tin complexes, and tin chelates of the (poly)amino(poly)carboxylic acid type as described in British patent specification No. 1,209,050, formaldehyde, hydrazine, hydroxylamine, phosphonium salts such as tetra(hydroxymethyl) phosphonium chloride, polyamines, e.g. diethylene triamine, bis(p-aminoethyl)sulphide and its water-soluble salts, etc.

The gold fogging agent is used in an amount from about 0.01 to about 0.1 millimole preferably from about 0.02 to about 0.05 millimole per mole of silver halide. Gold fogging may occur by means of any gold compound known for use in fogging photographic silver halide grains. Specific examples of gold fogging agents are potassium tetrachloroaurate, auric trichloride, potassium aurithiocyanate, etc. It is also possible to employ a mixture of a water-soluble gold compound e.g. auric trichloride and thiocyanates forming complexes with gold and having a solvent action on the silver halide grains e.g. alkali metal and ammonium thiocyanates. A preferred gold fogging agent is potassium tetrachloroaurate which is generally used at concentrations from about 5 mg to about 50 mg, preferably from about 10 mg to about 30 mg per mole of silver halide.

Fogging of the silver halide grains may be effected by using the reducing agent initially and subsequently using the gold compound. However, the reverse order of agents can be used or the reduction- and gold-fogging agents can be used simultaneously.

The pH, pAg and temperature conditions during fogging of the silver halide grains are subject to wide variation. Fogging is preferably effected at neutral or higher pH values e.g. a pH value of at least 6.5 and at a pAg value below 9, preferably below 8.35. The temperature is generally comprised between about 40° C and about 100° C, preferably from about 50° C to about 70° C.

The direct-positive silver halide Lippmann emulsions of the present invention are of the type comprising exterior electron traps by adsorption to the surface of the silver halide grains of one or more electron-accepting compounds preferably electron-accepting dyes.

Formerly such compounds were called desensitizers because dyes having a desensitizing effect in negative emulsions were particularly suitable for use in direct-positive emulsions (cfr. British patent specification No. 723,019).

According to Sheppart et al, Jl.Phys.Chem. 50(1946) 210, Stanienda, Z.Phys.Chem. (NF) 32 (1962) 238, and Dähne, Wiss. Phot. (1969)161, desensitizers were dyestuffs with a cathodic polarographic half-wave potential more positive than −1.0. Now, it is common practice to characterize the electron-acceptors for direct-positive emulsions as having an anodic polarographic half-wave potential and a cathodic polarographic half-wave potential that when added together give a positive sum. Methods of determining these polarographic half-wave potentials have been described e.g. in the U.S. Pat. Nos. 3,501,310 and 3,531,290.

The electron-accepting compounds preferably have spectrally sensitizing properties although it is also possible to use electron-accepting compounds that do not spectrally sensitize the emulsion or to use combinations of both types.

Particularly suitable classes of electron-accepting compounds which can be used in the Lippmann emulsions of the present invention are nitrostyryl and nitrobenzylidene dyes of the type described in U.S. Pat. No. 3,615,610 which can be represented by the formulae:

I.

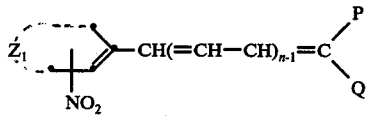

II.

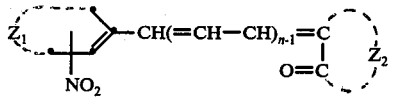

III.

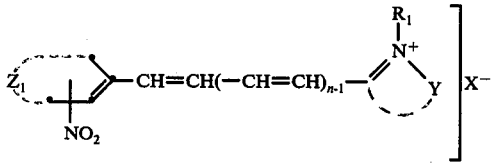

IV.

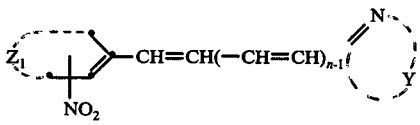

wherein one or more of the methine groups may be substituted e.g. with a cyano group, $R_1$ represents a substituent as commonly employed in cyanine dyes, especially a saturated or unsaturated aliphatic hydrocarbon group including such substituted group e.g. alkyl including substituted alkyl e.g. methyl, ethyl, propyl, butyl, β-hydroxyethyl, β-acetoxyethyl, sulphoethyl, sulphopropyl, sulphatopropyl, sulphatobutyl, carboxyethyl, carboxybutyl, cyanoethyl, a group —ACOOBSO$_2$OH wherein each of A and B represents a hydrocarbon group as described in the United Kingdom patent specification No. 886,271 or the group —A—W—NH—V—B, wherein A represents methylene, ethylene, propylene, or butylene, B represents alkyl, amino, substituted amino or if V is a single bond hydrogen, and each of W and V represents carbonyl, sulphonyl or a single bond, but at least one of them being sulphonyl as described in United Kingdom patent specification No. 904,332, a cycloalkyl group e.g. cyclohexyl and allyl, an aliphatic-aromatic hydrocarbon group including such substituted group e.g. benzyl and carboxybenzyl, an aromatic hydrocarbon group e.g. aryl including substituted aryl e.g. phenyl and carboxyphenyl, $X^-$ represents an anion e.g. chloride, bromide, iodide, perchlorate, methylsulphate, p-toluene sulphonate, etc. but is not present when $R_1$ itself contains an anionic group.

Y represents the atoms necessary to complete a heterocyclic nucleus of the type used in the production of cyanine dyes e.g. those of the thiazole, benzothiazole and naphthothiazole series, those of the oxazole, benzoxazole, and naphthoxazole series, those of the selenazole, benzoselenazole, and napthoselenazole series, those of the thiadiazole series, those of the 2-quinoline series, those of the pyrimidine series, those of the quinoxaline series, those of the quinazoline series, those of the 1-phthalazine series, those of the 2-pyridine series and those of the benzimidazole series, $Z_1$ represents the necessary atoms to close an aromatic nucleus e.g. a benzene nucleus, which may be further substituted e.g. with another nitro group, each of P and Q represents an organic group with electronegative character e.g.

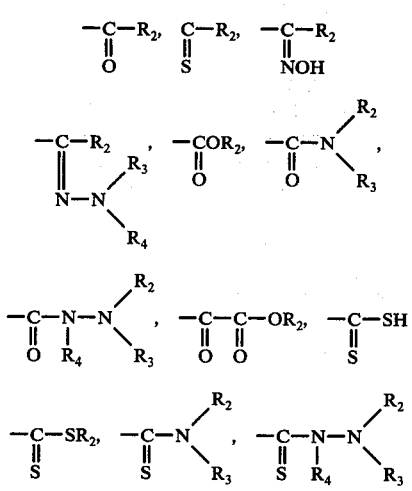

(wherein each of $R_2$, $R_3$ and $R_4$ represents a hydrogen atom, an alkyl group, an aryl group, an aralkyl group, or a heterocyclic group, which groups may be substituted), —NO$_2$, —CN, an aromatic homocyclic monovalent group e.g. phenyl or naphthyl, which group may be substituted preferably with an electronegative group as hereinbefore described or a monovalent heterocyclic group with aromatic character e.g. a furyl, thienyl, pyrrolyl, indolyl, or

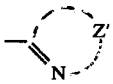

group, wherein Z′ represents the necessary atoms to close a heterocyclic nucleus with aromatic character, which groups may be substituted, $Z_2$ represents the necessary atoms to close a cyclic ketomethylene nucleus such as one of those of the pyrazolone series e.g. 3-methyl-1-phenyl-5-pyrazolone, 1-phenyl-5-pyrazolone, 1-(2-benzothiazolyl)-3-methyl-5-pyrazolone, those of the isoxazolone series e.g., 3-phenyl-5-isoxazolone, or 3-methyl-5-isoxazolone, those of the oxindole series, e.g. 1-alkyl-2,3-dihydro-2-oxindoles, those of the 2,4,6-triketohexahydropyrimidine series e.g. barbituric acid or 2-thiobarbituric acid as well as their derivatives such as those substituted in the 1-position by an alkyl group such as a methyl group, an ethyl group, an 1-n-propyl group, and a 1-n-heptyl group, or those substituted in the 1- and 3-position by an alkyl group, or those substituted in the 1- or 3-position by a β-methoxy-ethyl group, or those substituted in the 1- and 3-position by an aryl group such as phenyl group, or those substituted in the 1- and 3-position by a substituted phenyl group such as a p-chlorophenyl group, or a p-ethoxycarbonyl-phenyl group, or those substituted only in the 1-position by a phenyl-, p-chlorophenyl-, or p-ethoxycarbonylphenyl group, further the mixed alkyl-aryl-substituted derivatives such as 1-ethyl-3-phenyl, and 1-n-heptyl-3-phenyl derivatives, those of the rhodanine series i.e., 2-thio-2,4-thiazolidine-dione series, e.g. rhodanine, and aliphatically substituted rhodanines e.g., 3-ethyl-rhodanine, or 3-allylrhodanine, those of the imidazo[1,2-a]pyridone series, those of the 5,7-dioxo-6,7-dihydro-5-thiazole[3,2-a]pyrimidine series e.g. 5,7-dioxo-3-phenyl-6, 7-dihydro-5-thiazolo[3,2-a]pyrimidine, those of the 2-thio-2,4-oxazolidinedione series i.e. those of the 2-thio-2,4-oxazoledione series e.g. 3-ethyl-2-thio-2,4-oxazolidinedione, those of the thianaphthenone series e.g. 3-thianaphthenone, those of the 2-thio-2,5-thiazolidinedione series i.e. the 2-thio-2,5-thiazoledione series e.g. 3-ethyl-2-thio-2,5-thiazolidinedione, those of the 2,4-thiazolidinedione series e.g. 2,4-thiazolidinedione, 3-ethyl-2,4-thiazolidinedione, 3-phenyl-2,4-thiazolidinedione, 3-α-naphthyl-2,4-thiazolidinedione, those of the thiazolidone series e.g. 4-thiazolidone, 3-ethyl-4-thiazolidone, 3-phenyl-4-thiazolidone, 3-α-naphthyl-4-thiazolidone, those of the 4-thiazolone series e.g. 2-ethylmercapto-4-thiazolone, 2-alkylphenylamino-4-thiazolones, 2-diphenylamino-4-thiazolone, those of the 2-imino-2,4-oxazolinone i.e. pseudohydantoin series, those of the 2,4-imidazolinedione (hydantoin) series e.g. 2,4-imidazolinedione, 3-ethyl-2,4-imidazolinedione, 3-phenyl-2,4-imidazolinedione, 3-α-naphthyl-2,4-imidazolinedione, 1,3-diethyl-2,4-imidazolinedione, 1-ethyl-3-phenyl-2,4-imidazolinedione, 1-ethyl-3-α-naphthyl-2,4-imidazolinedione, 1,3-diphenyl-2,4-imidazolinedione, those of the 2-thio-2,4-imidazolinedione (i.e. 2-thiohydantoin) series, e.g., 2-thio-2,4-imidazolinedione, 3-ethyl-2-thio-2,4-imidazolinedione, 3-phenyl-2-thio-2,4-imidazolinedione, 3-α-naphthyl-2-thio-2,4-imidazolinedione, 1,3-diethyl-2-thio-2,4-imidazolinedione, 1-ethyl-3-phenyl-2-thio-2,4-imidazolinedione, 1-ethyl-3-α-naphthyl-2-thio-2,4-imidazolinedione, 1,3-diphenyl-2-thio-2,4-imidazolinedione, those of the 5-imidazolone series e.g. 2-n-propylmercapto-5-imidazolone, and those of the homocyclic ring systems represented by the following structural formulae:

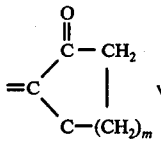
wherein m represents 1, 2, or 3, $H_2$

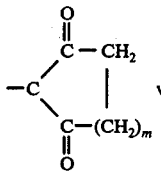
wherein m represents 1, 2, or 3,

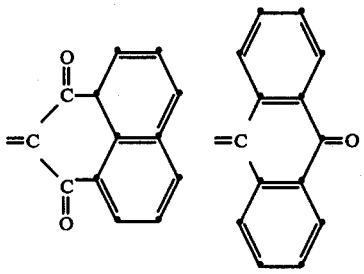

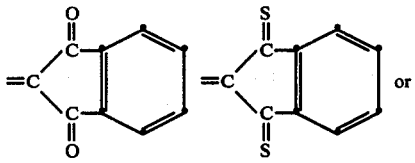
or

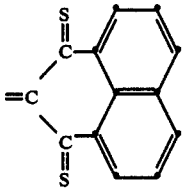

*n* represents a positive integer 1 or 2.

Other very suitable electron-accepting compounds for use in the emulsions according to the present invention are the dihydropyrimidine compounds of U.S. Pat. No. 3,779,776, which correspond to one of the following general formulae V or VI or a tautomeric form thereof:

V.

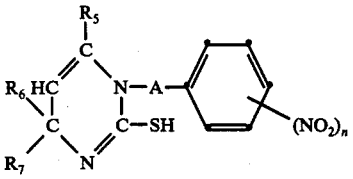

VI.

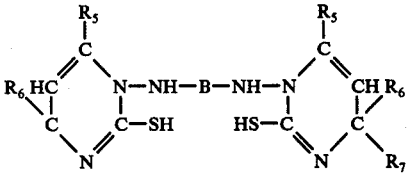

wherein:

$R_5$ is hydroxyl or $C_1$–$C_5$ alkyl, $R_6$ is hydrogen or $C_1$–$C_5$ alkyl,
$R_7$ is $C_1$–$C_5$ alkyl or aryl,
A is a single bond or NH,
B is a phenyl or diphenyl sulphone group in which the or both phenyl groups are substituted with one or more nitro groups, and
*n* is 1, 2 or 3.

As is known from this United States Patent the compounds corresponding to the above general formulae V and VI are not only suitable for use as such but it is also possible to use the corresponding disulphides thereof or precursor compounds e.g. compounds corresponding to the above general formulae V or VI or a tautomeric form thereof wherein the tautomeric hydrogen atom is replaced by a —COR′ group in which R′ represents alkyl, aryl, aralkyl or a residue identical to the diazine residue linked to the carbonyl group of —COR′, by a —$SO_2$R″ group in which R″ is alkyl, aryl or aralkyl or by a COOR‴ group wherein R‴ is alkyl or aryl.

Other useful electron acceptors are dyes of the type referred to in U.S. Pat. No. 3,531,290, which is incorporated herein by reference. These dyes include e.g. the symmetrical imidazo[4,5-b]quinoxaline cyanine dyes of Belgin Pat. No. 660,253, the symmetrical trimethine dyes with 2-aromatically e.g. 2-phenyl substituted indole nuclei of U.S. Pat. No. 2,930,694, unsymmetrical dimethine dyes with a 2-aromatically substituted indole nucleus and a desensitizing nucleus e.g. an imidazo[4,5-b]quinoxaline nucleus and a pyrrolo[2,3-b]pyrido nucleus, trimethine dyes with a pyrrolo[2,3-b]pyrido nucleus and a desensitizing nucleus e.g. 6-nitrobenzothiazole nucleus, 5-nitroindolenine nucleus, imidazo[4,5-b]quinoxaline nucleus and pyrrolo [2,3-b]pyrido nucleus, and dimethine dyes containing a pyrazolyl and an imidazo [4,5-b]quinoxaline nucleus.

Other useful electron acceptors are cyanine and merocyanine dyes, in which at least one nucleus, and preferably two nuclei, contain desensitizing substituents such as nitro groups.

Specific examples of electron acceptors suitable for use in accordance with the method of the present invention are phenosafranine, pinacryptol yellow, crystal violet, 1-ethyl-2-m-nitrostyryl-quinolinium bromide, 2-m-nitrostyryl-quinoline, 1-methyl-2-m-nitrostyryl-quinolinium methylsulphate, 5-m-nitrobenzylidene-rhodanine, 3-phenyl-5-m-nitrobenzylidene-rhodanine, 3-ethyl-5-m-nitrobenzylidene-rhodanine, 3-ethyl-5-(2,4-dinitrobenzylidene)-rhodanine, 3-phenyl-5-o-nitrobenzylidene-rhodanine, 1-(2,4-dinitroanilino)-4,4,6-trimethyl-dihydropyrimidine-2-thione, 1,1′-dimethyl-2,2′-diphenyl-3,3′-indolocarbocyanine bromide, 1,1′-dimethyl-2,2′-di(p-methoxyphenyl)-3,3′-indolocarbocyanine bromide, 1,1′-dimethyl-2,2′, 8-triphenyl-3,3′-indolocarbocyanine perchlorate, 1,1′,3,3′-tetraethylimidazo[4,5-b]quinoxaline carbocyanine chloride, 1,3-diethyl-1′-methyl-2′-phenyl-imidazo[4,5-b]quinoxalino-3′-indolocarbocyanine iodide, 6-chloro-1′-methyl-1,2′, 3-triphenylimidazo[4,5-b]quinoxalino-3′-indolo carbocyanine-p-toluene sulphonate, 1,1′,3,3′-tetramethyl-2-phenyl-3-indolopyrrolo [2,3-b]pyridocarbocyanine iodide, 1,1′,3,3,3′,3′-hexamethylpyrrolo[2,3-b]pyrido carbocyanine perchlorate, 5,5′-dichloro-3,3′-diethyl-6,6′-dinitrothiocarbocyanine iodide, 1,3-dialkyl -2-[2-(3,5-dimethyl-1-phenyl-4-pyrazolyl)vinyl]imidazo[4,5-b]quinoxalinium iodide, 1′,3-diethyl-6-nitrothia-2′-cyanine iodide, 3,3′-diethyl-6,6′-dinitrothiacarbocyanine ethylsulphate, 3,3′-di-p-nitrobenzylthiacarbocyanine iodide, 3,3′-di-o-nitrophenylthiacarbocyanine perchlorate, 4-nitro-6-chlorobenzotriazole, 2,3,5-triphenyl-2H-tetrazolium chloride, 2-(4-iodophenyl)-3-(4-nitrophenyl)-5-phenyl tetrazoliumchloride, 1-methyl-8-nitroquinolinium methylsulphate, 1-m-nitrobenzyl-quinolinium chloride, 1-m-nitrobenzyl-pyridinium chloride, 1-p-nitrobenzyl-isoquinoliniumchloride, 1-p-nitrobenzylbenzo[f]quinolinium chloride, anhydro-2-p-dimethylaminophenyliminoethyl-6-nitro-3-(4-sulphobutyl)benzothiazolium hydroxide, 1,3-diamino-5-methylphenazinium chloride, etc.

The amount of electron-accepting compound(s) in the direct-positive silver halide Lippmann emulsion of the invention is more than 2 g and at most about 10 g per mole of silver halide.

In the direct-positive Lippmann emulsions of the present invention various silver salts may be used as the light-sensitive salt e.g. silver bromide, silver bromoiodide, silver bromochloride and silver bromochloroiodide but it is preferred to use silver halides predominantly consisting of silver bromide e.g. silver bromide emulsions, which may have a silver iodide content of at most 8 mole %.

In the preparation of the direct-positive photographic silver halide emulsion for use in accordance with the present invention gelatin is preferably used as vehicle for the silver halide grains. However, the gelatin may be wholly or partly replaced by other natural hydrophilic colloids, e.g. albumin, zein, agar-agar, gum arabic, alginic acid, and derivatives thereof e.g. salts, amides and esters, starch and derivatives thereof, cellulose derivatives e.g. cellulose ethers, partially hydrolyzed cellulose acetate, carboxymethyl cellulose, etc. or synthetic hydrophilic resins, for example polyvinyl alcohol, polyvinyl pyrrolidone, homo- and copolymers of acrylic and methacrylic acid or derivatives e.g. esters, amides and nitriles, vinyl polymers e.g. vinyl ethers and vinyl esters.

The direct-positive silver halide emulsions for use in accordance with the present invention may comprise additional additives known to be beneficial in photographic emulsions. They may comprise spectrally sensitizing dyes that are not electron-accepting such as e.g. cyanines, merocyanines, complex (trinuclear) cyanines, complex (trinuclear) merocyanines, styryls, and hemicyanines, e.g. speed-increasing compounds, stabilizers, antistatic agents, coating aids, optical brightening agents, light-absorbing dyes, plasticizers and the like.

In the interest of high resolving power and acutance, scattering and reflection of light within the photographic material should be avoided. For this purpose light-absorbing dyes can be used in an antihalation layer coated on the back of a transparent support or between the support and the emulsion layer. It is also possible to incorporate light-absorbing dyes within the silver halide emulsion layer. Classes and representative examples of light-absorbing dyes for use in an antihalation layer or the emulsion layer can be found in British patent specification No. 1,298,335 and Belgin Pat. No. 699,375 as well as the patent literature referred to therein.

Examples of particularly suitable dyes for use in a direct-positive Lippmann emulsion according to the present invention are:

1.
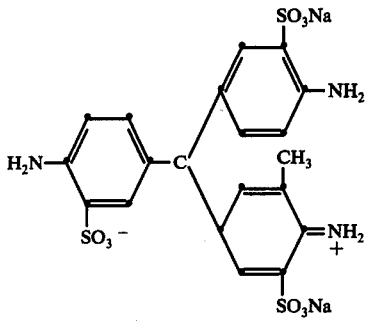
C.I Acid Violet 19
C.I. 42,685
2
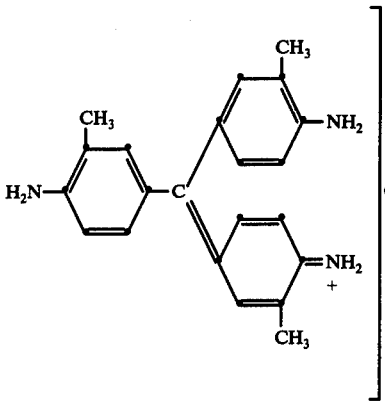
C.I. Basic Violet 20
C.I. 42,520
3.
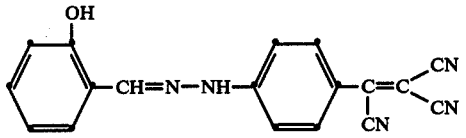
4.
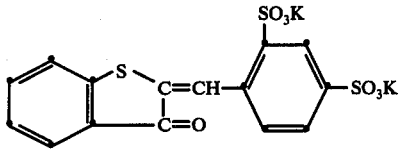
5.
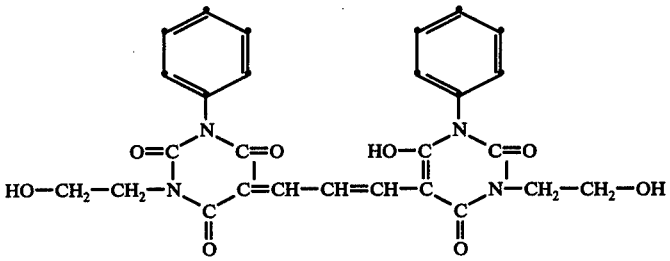
6.
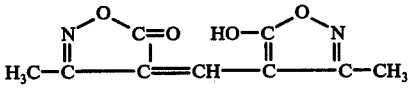
7.
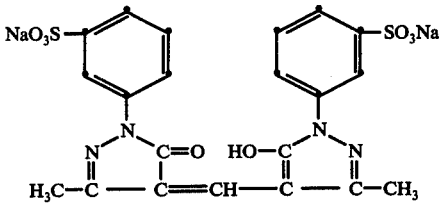

-continued
8.
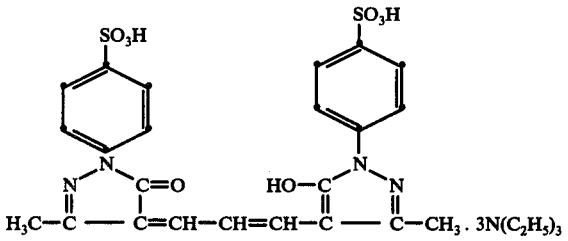
9.
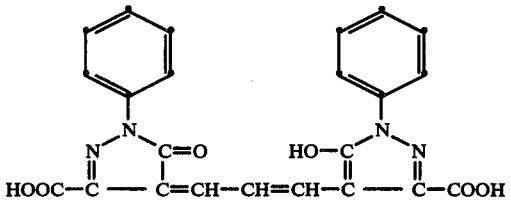
10.
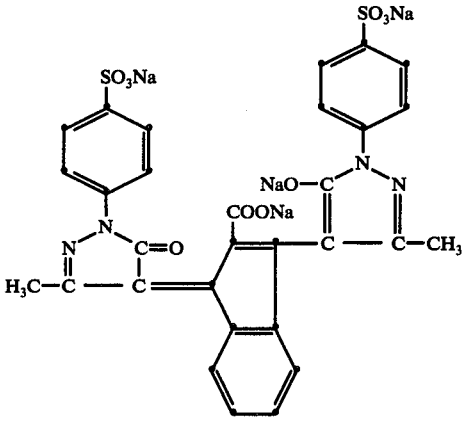
11.
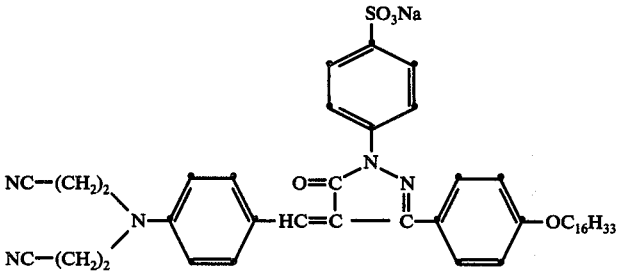
12.
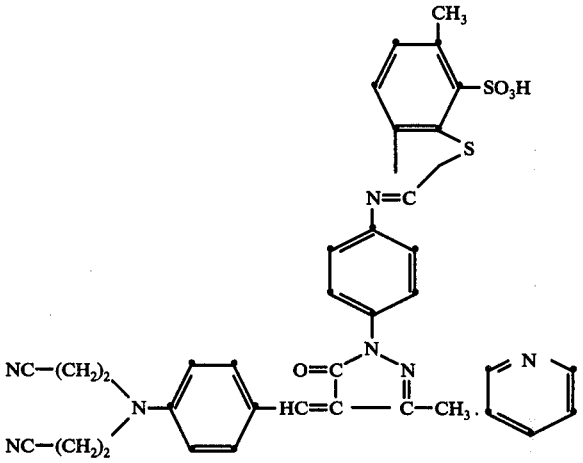

-continued

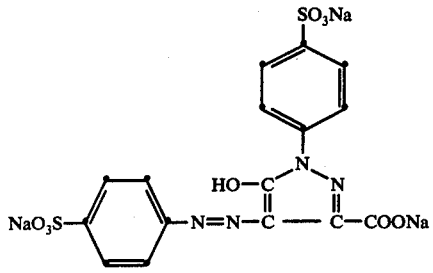

C.I. Acid Yellow 23
C.I. 19,140

13.

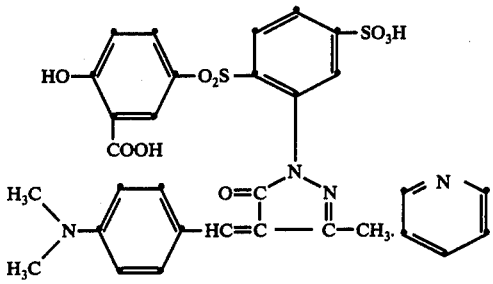

14.

The silver halide emulsion layer and other hydrophilic colloid layers of a direct-positive photographic material employed in accordance with the present invention may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides and vinyl sulphones, etc.

The sensitivity and stability of the direct-positive silver halide emulsions can be improved by coating the emulsions on the support at reduced pH value, preferably a pH of about 5, and/or at increased pAg value, preferably a pAg value which corresponds to an EMF of +30 mV or less (silver against saturated calomel electrode) as described in British Patent Application No. 32889/72. Adjustment of pH and pAg preferably occurs after addition of the electron-acceptor(s) in order to avoid possible grain-growth.

Development of the exposed direct-positive silver halide emulsions of the invention may occur in alkaline solutions containing conventional developing agents such as hydroquinones, catechols, aminophenols, 3-pyrazolidinones, ascorbic acid and derivatives, hydroxylamines, etc. or combinations of developing agents.

Development may occur by means of a combination of developing agents that have a superadditive action, e.g. hydroquinone together with N-methyl-p-aminophenol sulphate or other p-aminophenol derivatives and hydroquinone together with 1-phenyl-3-pyrazolidinone or other 3-pyrazolidinone derivatives.

The direct-positive silver halide emulsions can be coated on one or both sides of a wide variety of supports, which include opaque supports e.g. paper and metal supports as well as transparent supports e.g. glass, cellulose nitrate film, cellulose ester film, polyvinyl acetal film, polystyrene film, polyethylene terephthalate film, polycarbonate film and other films of resinous materials. It is also possible to use paper coated with α-olefin polymers e.g. paper coated with polyethylene, polypropylene, ethylenebutene copolymers etc.

In the manufacture of direct-positive high resolution plate materials for the preparation of masks for use in the electronic industry, glass supports are most advantageously used in view of their high dimensional stability. In order to promote adhesion of the emulsion layer or an intermediate layer e.g. antihalation layer to glass supports in the preparation of high resolution plate materials, the silicon compounds described in British patent specification No. 1,286,467 can be incorporated into the emulsion layer or intermediate layer.

The following example illustrates that in order to obtain satisfactory direct-positive Lippmann emulsions, the emulsions should be reduction- and gold-fogged and comprise one or more electron-accepting compounds to the level defined according to the present invention.

EXAMPLE

A monodisperse, cubic direct-positive silver bromoiodide emulsion (3 mole % of iodide) was prepared by the simultaneous addition of an aqueous solution of potassium bromide and potassium iodide and an aqueous solution of silver nitrate to a rapidly agitated aqueous gelatin solution over a period of about 15 minutes. The conditions of pecipitation were adjusted so that a Lippmann emulsion with an average grain-size of about 70 nm was obtained.

The emulsion was chillset, shredded and washed with cold water, whereupon gelatin was added. The emulsion comprised per kg an amount of silver halide corresponding to 75 g of silver nitrate and had a ratio of gelatin to silver halide, expressed as silver nitrate, of 0.6.

The emulsion was divided into several aliquot samples, which were fogged by digestion for 60 min. at 57° C, pH 7 and pAg 8.18 in the presence of thiourea dioxide and potassium tetrachloroaurate in the amounts listed in the table hereinafter per mole of silver halide. To the various samples different amounts of the electron-acceptor pinacryptol yellow (A) and the spectrally sensitizing dye (B) corresponding to the formula:

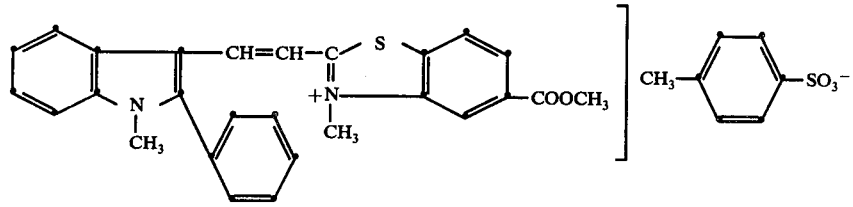

were added as listed in table 1, whereupon the pAg and pH of the emulsion samples were adjusted to 9.68 and 5 respectively.

The emulsion samples were coated on a conventional support, dried, exposed in a sensitometer, and developed for 3 min. at 20° C in a developer of the following composition:

| | |
|---|---|
| water | 800 me |
| p-monomethylaminophenol sulphate | 1.5 g |
| hydroquinone | 6 g |
| anhydrous sodium sulphite | 50 g |
| anhydrous sodium carbonate | 32 g |
| potassium bromide | 2 g |
| ethylene diamine tetraacetic acid trisodium salt | 1.5 g |
| water to make | 1 liter |

After development, the emulsions were fixed, washed and dried in the usual manner. The sensitometric results attained are listed in the table hereinafter. The values given for the speed are relative values for the speed measured at ($D_{max}$-$D_{min}$/2) unless otherwise stated. The values given for the gamma in the toe ($\gamma_t$) of the characteristic curve are the average gradients measured over an exposure range measured between density 0.1 and 0.5 above $D_{min}$.

Table

| mmole Au-compound per mole AgX | 0.04 | | | | 0.02 | | 0.0066 | | 0.0033 | |
|---|---|---|---|---|---|---|---|---|---|---|
| milliequivalent reductor per mole AgX | 0.14 | | 0.031 | — | 0.14 | | 0.031 | 0.14 | 0.14 | 0.50 |
| g A and g B per mole AgX | 2.4 g A + 1 g B | 1.2 g A + 0.5 g B | 2.4 g A + 1 g B | 2.4 g A + 1 g B | 2.4 g A + 1 g B | 1.2 g A + 0.5 g B | 2.4 g A + 1 g B | 2.4 g A + 1 g B | 2.4 g A + 1 g B | 2.4 g A + 1 g B |
| $D_{min}$ | 0.04 | 0.13(1) | 0.05 | 0.03 | 0.03 | 0.08(1) | 0.03 | 0.03 | 0,03 | 0.03 |
| $D_{max}$ | >6 | >6 | 1.32 | 0.03 | 3.22 | 5.35 | 0.50 | 0.17 | 0.06 | 0.06 |
| relative speed | 100(2) | 63(2) | 550 | — | 182 | 120(2) | 550 | — | — | — |
| $\gamma$ | >10 | >10 | 0.96 | — | 4 | > 4 | 0.43 | — | — | — |
| $\gamma t$ | 2.5 | 1.35 | 0.82 | — | 2.8 | 1.85 | — | — | — | |

(1)the unacceptable $D_{min}$ obtained is due to a very persistent overall yellowing.
(2)the speed wqs measured at D = 2.

The above results show:

1. that when the amount of gold compound is below the limit of the invention, there is no usable direct-positive image-formation;

2. that when sufficient gold compound is used, gamma and $D_{max}$ are too low when the amount of reductor is below the limit of the invention, and 3. that when sufficient gold compound and reductor are used, the highlight areas show unacceptable yellowing in case the amount of electron acceptors is below the limit of the invention.

We claim:

1. A direct-positive silver halide emulsion comprising reduction- and gold-fogged silver halide grains and at least one electron accepting compound having an anodic polarographic half-wave potential and a cathodic polarographic half-wave potential, which when added together give a positive sum, wherein the silver halide grains have an average grain diameter of less than 100 nm, the silver halide grains are fogged with, per mole of silver halide, from about 0.07 to about 0.5 milliequivalents of reduction-fogging agent and from about 0.01 to about 0.1 millimole of gold fogging agent, and the emulsion comprises per mole of silver halide more than 2 g and at most 10 g of electron-accepting compound(s).

2. A direct-positive silver halide emulsion according to claim 1 wherein the silver halide grains are fogged with from about 0.1 to about 0.3 milliequivalents of reduction fogging agent per mole of silver halide.

3. A direct-positive silver halide emulsion according to claim 1 wherein the silver halide grains are fogged with from about 0.02 millimole to about 0.05 millimole of gold fogging agent per mole of silver halide.

4. A direct-positive silver halide emulsion according to claim 1, wherein the reduction fogging agent is thiourea dioxide.

5. A direct-positive silver halide emulsion according to claim 1, wherein the gold fogging agent is potassium tetrachloroaurate.

6. A direct-positive silver halide emulsion according to claim 1 wherein the silver halide grains are fogged at a pH value above 6.5.

7. A direct-positive silver halide emulsion according to claim 1 wherein the silver halide grains are fogged at a pAg value below 9.

8. A direct-positive silver halide emulsion according to claim 1, wherein the emulsion comprises a nitrostyryl or nitrobenzylidene electron acceptor.

9. A direct-positive silver halide emulsion according to claim 1 wherein the emulsion is a silver bromide emulsion, which may have a silver iodide content of at most 8 mole %.

10. A direct-positive silver halide emulsion according to claim 1 wherein the emulsion comprises a light-absorbing dye to avoid scattering of light in the emulsion.

* * * * *